US005968694A

United States Patent [19]

Sakai et al.

[11] Patent Number: 5,968,694

[45] Date of Patent: Oct. 19, 1999

[54] PHOTOCONDUCTIVE PAINT AND ELECTROPHOTOGRAPHIC PHOTOSENSITIVE BODY EMPLOYING IT

[75] Inventors: Hideki Sakai, Tachikawa; Takafumi Hirano, Tokyo; Daijou Tomihisa; Shigefumi Kuramoto, both of Osaka, all of Japan

[73] Assignees: Iwatsu Electro Co., Ltd., Tokyo; Nippon Shokubai, Osaka, both of Japan

[21] Appl. No.: 09/067,744

[22] Filed: Apr. 28, 1998

[30] Foreign Application Priority Data

May 12, 1997 [JP] Japan ..... 9-121191

[51] Int. Cl.[6] ..... G03G 5/05

[52] U.S. Cl. ..... 430/56; 430/96; 430/89

[58] Field of Search ..... 430/96, 87, 89, 430/56

[56] References Cited

U.S. PATENT DOCUMENTS

| | | | |
|---|---|---|---|
| 3,944,682 | 3/1976 | Miyatsuka et al. | 430/87 |
| 4,283,474 | 8/1981 | Kaneko et al. | 430/87 |
| 4,427,754 | 1/1984 | Uchida et al. . | |
| 4,853,307 | 8/1989 | Tam et al. . | |
| 5,683,501 | 11/1997 | Tomihisa et al. . | |

FOREIGN PATENT DOCUMENTS

| | | |
|---|---|---|
| 50-31011 | 3/1975 | Japan . |
| 54-020735 | 2/1979 | Japan . |
| 56-087427 | 6/1981 | Japan . |
| 58-68046 | 10/1981 | Japan . |
| 60-10254 | 6/1983 | Japan . |

*Primary Examiner*—Christopher D. Rodee
*Attorney, Agent, or Firm*—Paul and Paul

[57] ABSTRACT

The present invention provides photoconductive paints which have excellent dispersability and dispersion stability and which allow formation of coatings with high coating strength and excellent smoothness.

The invention relates to photoconductive paint composed primarily of an inorganic photoconductive material and a binding resin formed on a conductive substrate, wherein the binding resin contains compound fine particles (A) and a resin (B) as defined below, in a solid weight ratio of compound fine particles (A)/resin (B) in the range of 0.5/9.5–4.0/6.0.

The compound fine particles (A) have an organic polymer bound to surfaces of inorganic fine particles, and the resin (B) is a resin composition obtained by polymerizing an acrylic monomer mixture, the resin having an acid value of 2.0–12.0.

2 Claims, No Drawings

PHOTOCONDUCTIVE PAINT AND ELECTROPHOTOGRAPHIC PHOTOSENSITIVE BODY EMPLOYING IT

BACKGROUND OF THE INVENTION

1. Technical Field

The present invention relates to an electrophotographic photosensitive body and a photoconductive paint, and specifically it relates to an electrophotographic photosensitive body with excellent imaging properties, electrical characteristics and stability against environmental changes, and which provides superior printing resistance, desensitization reactivity and desensitized coating formability when used for electrophotographic lithographic printing plates, as well as to a photoconductive paint of which the electrophotographic photosensitive body is composed.

2. Description of the Related Art

Electrophotographic photosensitive bodies composed of conductive substrates and photoconductive layers are employed in the common electrophotographic process known as the Carlson process, i.e. for formation of images by electrification, exposure and development, and they are also employed in a broad range of practical methods as plates for lithographic printing after image formation.

Binding resins used for formation of photoconductive layers of electrophotographic photosensitive bodies are required to have satisfactory film-forming properties, adhesion to photoconductive layers formed on conductive substrates, and dispersion of inorganic photoconductive powders in the binding resins, as well as suitable performance in terms of imaging properties and electrical characteristics for electrophotographic photosensitive bodies, and must also maintain stable performance regardless of changes in the environment during imaging.

When used for photoconductive paints, consistently stable dispersion of inorganic photoconductive powders is a requirement.

Silicone resins, alkyd resins, acrylic resins (acrylic ester copolymers, etc.) and mixtures of such resins have long been publicly known as resins used for electrophotographic photosensitive bodies and photoconductive paints.

However, the use of these conventional resins has been associated with a number of problems, including:

1) a lack of affinity with inorganic photoconductive powders, and poor dispersion when prepared as photoconductive paints;

2) Inferior reproducibility of photographed images;

3) Susceptibility to environmental changes during imaging (temperature and humidity fluctuations);

4) When used for lithographic printing plates, insufficient film strength and adhesion of photosensitive layers, resulting in inconveniences such as peeling of photosensitive layers during printing;

5) With lithographic printing plates, low reactivity with desensitizing fluids and generation of scum during printing.

As an improvement for photoconductive layer binding resins there has been disclosed a process which provides enhanced imaging properties, electrical characteristics and humidity resistance, using an acrylic resin with an acid value of 4–50, in a combination of a component with a molecular weight distribution of $10^3$–$10^4$ and a component with a molecular weight distribution of $10^4$–$2\times10^5$ (Japanese Unexamined Patent Publication No. 60-10254).

Research is diligently being pursued on lithographic printing plates employing electrophotographic photosensitive bodies, and there has been disclosed a binding resin for photoconductive layers which exhibits both the imaging properties and electrical characteristics of electrophotographic photosensitive bodies and the printing properties of printing plates, wherein, for example, a resin with a molecular weight of $1.8\times10^4$–$10^5$ and a glass transition point of 10–80° C., obtained by copolymerizing a (meth)acrylate monomer with another monomer in the presence of fumaric acid, is combined with a copolymer comprising a (meth) acrylate monomer and another monomer other than fumaric acid (Japanese Unexamined Patent Publication No. 50-31011).

Also disclosed is the use of quadripolymers or pentapolymers containing acrylic acid and hydroxy (meth)acrylate (see Japanese Unexamined Patent Publication Nos. 54-20735 and 57-202544), and the use of terpolymers containing (meth)acrylic acid esters substituted with alkyl groups of 6 or more carbon atoms and carboxylic acid-containing vinyl monomers has been described as having an effect of improving desensitizing properties of photoconductive layers (Japanese Unexamined Patent Publication No. 58-68046).

Nevertheless, actual evaluation of resins considered to have the aforementioned effects in terms of imaging properties, electrical characteristics and humidity resistance reveals that even they are not satisfactory in practice, in terms of their antistatic properties, electrical characteristics such as retention of light damping and darkness damping, and imaging properties such as degree of scum on non-image sections and image density, or in terms of their stability against environmental changes during imaging; an additional problem has been their weak coating strength on photoconductive layer surfaces, which leads to abrasion damage to surfaces and indentation smudges on imaged objects and printed products.

Even in the case of binding resins considered to have effects of improving desensitizing properties of lithographic printing plates, actual evaluation shows that when desensitizing treatment is carried out by hand etching, which gives a high desensitizing treatment effect, some slight degree of spotted scum is produced, but when desensitizing treatment is carried out using etching processors which have become popular in recent years and have a low desensitizing treatment effect, scum is produced over the entire surface.

Thus, when desensitizing treatment is carried out using an etching processor, it is common to employ a method whereby treatment is effected twice with the processor. However, although such repeated treatment methods have an effect on scum produced over the entire surface, there is a high tendency toward spotted contamination on the printed product, compared to hand etching treatment which has an effect against spotted scum.

SUMMARY OF THE INVENTION

Object of the Invention

It has been demonstrated that even binding resins for electrophotographic photosensitive bodies, where the resins provide improved electrical characteristics, imaging properties and humidity resistance, are still inadequate for maintaining stability against changes during imaging from an environment of high temperature and high humidity to one of low temperature and low humidity, and also still have problems with dispersability and dispersion stability of photoconductive paints as well as the coating strength and the smoothness of photoconductive layer surfaces.

Furthermore, since spotted scum significantly affects the value of printed products from electrophotographic lithographic printing plates, there is a strong demand for lithographic printing plates which produce no spotted scum on printed products when desensitizing treatment is carried out by etching processors.

In addition, for recently popular automatic photoengraving/printing systems which combine photoengravers and etching processors, or etching processors and printers, or photoengravers, etching processors and printers, it is preferred in terms of system construction to employ a single-step etching processor as the method for desensitizing treatment.

Consequently, there is a demand for the development of lithographic printing plates which produce no scum on printed products even with single-pass processors.

Also, with the recent rise in the volume of photographs and fine-lined prints as printed products, the quality of printed products is becoming a major issue. Hence, there is also a demand for development of lithographic printing plates with superior print imaging properties.

The present invention overcomes the aforementioned problems associated with conventional electrophotographic photosensitive bodies.

It is an object of the invention to provide a photoconductive paint which has excellent dispersability and dispersion stability and which allows formation of coatings with high strength and excellent smoothness. It is also an object to provide an electrophotographic photosensitive body which has excellent electrical characteristics and which maintains clear and favorable imaging properties in a stable manner regardless of the environment during formation of images, and finally to provide lithographic printing plates which have excellent printing resistance when such electrophotographic photosensitive bodies are used as electrophotographic lithographic printing plates, and which exhibits superior desensitizing reactivity and desensitized coating formation without producing indentation due to abrasion and the like, and without producing scum.

Disclosure of the Invention

The present inventors have discovered for the first time that these objects of the invention can be achieved by a photoconductive paint composed primarily of an inorganic photoconductive material and a binding resin formed on a conductive substrate, and an electrophotographic photosensitive body employing it, which photoconductive paint and electrophotographic photosensitive body employing it are characterized in that the binding resin contains compound fine particles (A) and a resin (B), in a solid weight ratio of compound fine particles (A)/resin (B) from 0.5/9.5–4.0/6.0.

The compound fine particles (A) according to the invention are defined as

Compound fine particles (organic polymer-combined inorganic fine particles) wherein an organic polymer is bound to surface of inorganic fine particles, the average particle diameter is 5–200 nm, and the coefficient of particle diameter variation is not greater than 50%.

The inorganic fine particles in the compound fine particles are fine particles of an inorganic material which may be composed of any desired element, although inorganic oxides are particularly preferred for use as the inorganic material. Inorganic oxides are defined as any of various metallic oxygen-containing compounds wherein the metal atoms are configured into a 3-dimensional network primarily through bonds with oxygen atoms. The metal atoms composing the inorganic oxide are preferably elements selected from Groups II–VI of the periodic table, and more preferably elements selected from Groups III–V of the periodic table. Among these, elements selected from among Al, Si, Ti and Zr are particularly preferred, with silica fine particles, in which the metal element composing the inorganic oxide is Si, being the most preferred (see U.S. Pat. No. 5,683,501).

In addition, these inorganic oxides may also contain organic groups or hydroxyl groups, or residues of different groups derived from the metallic compounds used as starting materials described below, or they may also include parts of organic polymers. The organic groups may be at least one type selected from the group consisting of alkyl, cycloalkyl, aryl and aralkyl groups of up to 20 carbon atoms and optionally substituted.

According to the invention, a single inorganic oxide or a combination of 2 or more may be used.

The inorganic fine particles made of such inorganic oxides may be in the form of spheres, needles, sheets, scales or shreds as desired and with no particular restrictions, but from the standpoint of dispersability in the paint, they are preferably in spherical or nearly spherical form.

The organic polymer in the compound fine particles (A) according to the invention gives the inorganic particles better dispersability in the paint and better affinity with the organic binder in the paint.

There are no particular restrictions on the molecular weight, form, composition or presence of functional groups of the organic polymer, and any desired organic polymer may be used. The organic polymer may be used in any desired form, including linear, branched and crosslinked structures. The molecular weight of the organic polymer is not particularly restricted, but it is preferably not greater than 200,000, and more preferably not greater than 50,000, in terms of number average molecular weight. Higher molecular weights are not preferred since such polymers may not dissolve in the organic solvent of the paint.

As concrete examples of resin components of organic polymers there may be mentioned (meth)acrylic resins, polystyrene, polyvinyl acetate, polyethylene and polypropylene and other polyolefins, polyvinyl chloride, polyvinylidene chloride, polyethylene terephthalate and other polyesters, including their copolymers, as well as resins which have been partially modified with functional groups such as amino, epoxy, hydroxyl and carboxyl groups. Among these, compound fine particles wherein the essential component as the organic polymer is one containing a (meth)acrylic unit, are preferred for the photoconductive paints to be described below.

DETAILED DESCRIPTION OF THE INVENTION

The compound fine particles (A) according to the invention are composite fine particles, wherein an organic polymer is bound to surfaces of inorganic fine particles, and "bound" here refers not simply to adhesion or cohesion, but means rather that the organic polymer is not detected in a solution where the compound fine particles (A) are washed with the desired solvent; this strongly suggests chemical bonding between the organic polymer and the inorganic fine particles.

The compound fine particles (A) may include an organic polymer inside the inorganic fine particles. This can give appropriate softness and tenacity to the inorganic fine particles which are the core of the compound fine particles (A).

The average particle diameter of the compound fine particles (A) is 5–200 nm, and preferably 5–100 nm. If the average particle diameter of the compound fine particles (A) is less than 5 nm, the surface energy of the compound fine particles (A) increases, tending to result in aggregation. Conversely, if the average particle diameter of the compound fine particles exceeds 200 nm, there will be a reduction in the electrophotographic characteristics of the resulting electrophotographic photosensitive body, including its electrical characteristics and imaging properties.

The coefficient of particle diameter variation of the compound fine particles (A) is not greater than 50%, and preferably not greater than 30%. If the particle diameter distribution of the compound fine particles (A) is too wide, that is, if the coefficient of particle diameter variation is greater than 50%, undesirable irregularities will be produced on the surface of the resulting electrophotographic photosensitive body.

The average particle diameter and coefficient of variation of the compound fine particles (A) were determined by the following method.

(Average Particle Diameter)

The particles were photographed with a transmission electron microscope, and the diameters of 100 randomly selected particles were read and their average taken as the average particle diameter.

(Coefficient of Variation)

The coefficient of variation was calculated according to the following equation.

Coefficient of variation=(standard deviation of particle diameter)/(average particle diameter)

The compound fine particles (A) may also contain alkoxy groups, in which case the alkoxy group content is preferably 0.01–50 mmol per gram of the compound fine particles (A). Here, an alkoxy group is an RO group attached to the metal element forming the skeleton of the fine particles. R represents an alkyl group which may be substituted, and the RO groups in the particles may be identical or different.

Such alkoxy groups act to complement the dispersability of the fine particles in the paint and their affinity with the organic binder.

The content of inorganic material in the compound fine particles (A) is not particularly restricted, but is preferably from 20 to 80 wt %. The hardness and other properties of the inorganic material can be more effectively exhibited by including the inorganic material at a content of at least 20% in the fine particles (A), and the dispersion stability of the fine particles (A) in the paint can be improved by limiting the inorganic material content in the fine particles (A) to preferably not greater than 80%.

Compound Fine Particles

The compound fine particles (A) used according to the present invention may be produced by any desired method, as will now be described.

Production Example 1

Production of polymerizable polysiloxane (S-1)

After placing 144.5 g of tetramethoxysilane, 23.6 g of γ-methacryloxypropyl trimethoxysilane, 19 g of water, 30.0 g of methanol and 5.0 g of Amberlyst 15 (cation exchange resin, product of Rohm and Haas, Japan Inc.) in a 300 ml 4-necked flask equipped with a stirrer, thermometer and cooling tube, the contents were stirred at 65° C. for 2 hours for reaction. After cooling the reaction mixture to room temperature, the cooling tube was replaced with a distillation tube provided with a cooling tube and an effusion outlet connected thereto, after which the temperature was raised to 80° C. over 2 hours under normal pressure, and this temperature was maintained until no more methanol effused off. A temperature of 90° C. was then maintained under a pressure of 200 mmHg until no more methanol effused off, and the reaction was allowed to proceed. After again cooling to room temperature, the Amberlyst 15 was filtered off to obtain polymerizable polysiloxane (S-1) with a number average molecular weight of 1800.

Production Example 2

Production of organic polymer (P-1)

After placing 200 g of toluene as an organic solvent in a 1 liter flask equipped with a stirrer, dropping orifice, thermometer, cooling tube and $N_2$ gas inlet, $N_2$ gas was introduced and the flask was heated to an internal temperature of 110° C. while stirring. Next, a mixed solution of 20 g of the polymerizable polysiloxane (S-1) obtained in Production Example 1, 80 g of methyl methacrylate, 10 g of 2-ethylhexyl acrylate, 60 g of styrene, 30 g of butyl acrylate and 6 g of 2,2'-azobisisobutyronitrile was added dropwise through the dropping orifice over a period of 2 hours. After continued stirring for one hour at the same temperature following the dropwise addition, 0.4 g of 1,1'-bis(t-butylperoxy)-3,3,5-trimethylcyclohexane was added twice every 30 minutes, and heating was continued for 2 hours for copolymerization to obtain a solution of organic polymer (P-1) with a number average molecular weight of 12,000, dissolved in toluene. The solid portion of the solution was 49.5%.

Production Example 3

Production of compound fine particle dispersion (A-1)

After placing 496 g of butyl acetate and 124 g of methanol in a 1 liter 4-necked flask equipped with a stirrer, two dropping orifices (dropping orifice A and B) and a thermometer, the internal temperature was adjusted to 20 ° C. Next, while stirring inside the flask, there were added dropwise over one hour a mixed solution (solution α-1) containing 27 g of the toluene solution of organic polymer (P-1) obtained in Production Example 2 and 72 g of tetramethoxysilane (inorganic particles produced by reaction with water during the polymerization step of production) through dropping orifice A, and a mixed solution (solution β-1) containing 28 g of water, 9 g of 25% ammonia water and 37 g of methanol through dropping orifice B. After the dropwise addition, stirring was continued for 2 hours at the same temperature. Next, a mixed solution containing 37 g of the toluene solution of organic polymer (P-1) and 37 g of butyl acetate was added dropwise over one hour through dropping orifice A. After this dropwise addition, stirring was continued for 2 hours at the same temperature. The internal temperature of the flask was then raised to 100° C. under a pressure of 110 mmHg, distilling off the ammonia, methanol, toluene and butyl acetate until the solid concentration reached 30%, to obtain a dispersion (A-1) of the compound fine particles dispersed in butyl acetate. The resulting compound fine particles had an average particle diameter of 27 nm and a coefficient of variation of 16%, while the compound fine particles had a methoxy group content of 0.03 mmol/g and a butoxy group content of 0.11 mmol/g, and the dispersion exhibited satisfactory extended storage stability at 50° C.

Production Example 4

Production of compound fine particle dispersion (A-2)

After placing 570 g of butyl acetate and 140 g of methanol in a 1 liter 4-necked flask equipped with a stirrer, two dropping orifices (dropping orifice A and B) and a thermometer, the internal temperature was adjusted to 20° C.

Next, while stirring inside the flask, there were added dropwise over one hour a mixed solution (solution α-2) containing 63 g of the toluene solution of organic polymer (P-1) obtained in Production Example 2 and 3.5 g of tetramethoxysilane through dropping orifice A, and a mixed solution (solution β-2) containing 5 g of water, 2 g of 25% ammonia water and 7 g of methanol through dropping orifice B. After the dropwise addition, stirring was continued for 2 hours at the same temperature. The internal temperature of the flask was then raised to 100 ° C. under a pressure of 110 mmHg, distilling off the ammonia, methanol, toluene and butyl acetate until the solid concentration reached 30%, to obtain a dispersion (A-2) of the compound fine particles dispersed in butyl acetate. The resulting compound fine particles had an average particle diameter of 5 nm and a coefficient of variation of 27%, while the compound fine particles had a methoxy group content of 0.01 mmol/g and a butoxy group content of 0.08 mmol/g, and the dispersion exhibited satisfactory extended storage stability at 50° C.

Production Example 5

Production of compound fine particle dispersion (A-3)

After placing 400 g of butyl acetate and 100 g of methanol in a 1 liter 4-necked flask equipped with a stirrer, two dropping orifices (dropping orifice A and B) and a thermometer, the internal temperature was adjusted to 20° C. Next, while stirring inside the flask, there were added dropwise over one hour a mixed solution (solution α-3) containing 2.1 g of the toluene solution of organic polymer (P-1) obtained in Production Example 2 and 81.5 g of tetramethoxysilane through dropping orifice A, and a mixed solution (solution β-3) containing 31 g of water, 10 g of 25% ammonia water and 41 g of methanol through dropping orifice B. After the dropwise addition, stirring was continued for 2 hours at the same temperature. Next, a mixed solution containing 69 g of the toluene solution of organic polymer (P-1) and 69 g of butyl acetate was added dropwise over one hour through dropping orifice A. After this dropwise addition, stirring was continued for 2 hours at the same temperature. The internal temperature of the flask was then raised to 100° C. under a pressure of 110 mmHg, distilling off the ammonia, methanol, toluene and butyl acetate until the solid concentration reached 30%, to obtain a dispersion (A-3) of the compound fine particles dispersed in butyl acetate. The resulting compound fine particles had an average particle diameter of 200 nm and a coefficient of variation of 13%, while the compound fine particles had a methoxy group content of 0.03 mmol/g and a butoxy group content of 0.12 mmol/g, and the dispersion exhibited satisfactory extended storage stability at 50° C.

Production Example 6

Production of compound fine particle dispersion (A-4)

After placing 400 g of butyl acetate and 100 g of methanol in a 1 liter 4-necked flask equipped with a stirrer, two dropping orifices (dropping orifice A and B) and a thermometer, the internal temperature was adjusted to 20° C. Next, while stirring inside the flask, there were added dropwise over one hour a mixed solution (solution α-4) containing 1.8 g of the toluene solution of organic polymer (P-1) obtained in Production Example 2 and 82.5 g of tetramethoxysilane through dropping orifice A, and a mixed solution (solution β-4) containing 31 g of water, 10 g of 25% ammonia water and 41 g of methanol through dropping orifice B. After the dropwise addition, stirring was continued for 2 hours at the same temperature. Next, a mixed solution containing 70 g of the toluene solution of organic polymer (P-1) and 70 g of butyl acetate was added dropwise over one hour through dropping orifice A. After this dropwise addition, stirring was continued for 2 hours at the same temperature. The internal temperature of the flask was then raised to 100° C. under a pressure of 110 mmHg, distilling off the ammonia, methanol, toluene and butyl acetate until the solid concentration reached 30%, to obtain a dispersion (A-4) of the compound fine particles dispersed in butyl acetate. The resulting compound fine particles had an average particle diameter of 220 nm and a coefficient of variation of 14%, while the compound fine particles had a methoxy group content of 0.02 mmol/g and a butoxy group content of 0.13 mmol/g, and the dispersion exhibited satisfactory extended storage stability at 50° C.

Resin (B) used according to the present invention is:

a resin which is a resin composition obtained by polymerizing an acrylic monomer mixture, and which has an acid value of 2.0–12.0.

The acrylic monomer mixture used for production of resin (B) is an ester obtained from acrylic acid or methacrylic acid and an alcohol including a hydrocarbon group with 1–12 carbon atoms, of which representative examples include (meth)acrylates wherein the hydrocarbon group is methyl, ethyl, n-butyl, t-butyl, n-propyl, isopropyl, 2-ethylhexyl, n-lauryl, cyclohexyl, benzyl, etc. It may be copolymerized if necessary, from monomers including styrene derivatives such as styrene, α-methylstyrene, p-bromostyrene and β-chlorostyrene; organic nitrites such as acrylonitrile, methacrylonitrile and a-methylglutaronitrile; and organic acid vinyl esters such as vinyl acetate, vinyl propionate and vinyl isopropionate.

As copolymerizable unsaturated acids there may be used acrylic acid, methacrylic acid, itaconic acid, α-methyleneglutaric acid and other α.β-ethylenic unsaturated carboxylic acids; crotonic acid, maleic acid and other copolymerizable carboxylic acid, or hydroxyalkyl (meth) acrylates and other hydroxyalkyl esters of α.β-ethylenic unsaturated carboxylic acids. One or a combination of 2 or more of the aforementioned acrylic monomers are polymerized, and the copolymerizable unsaturated acid is adjusted to a resin acid value of 2 to 12. Here, the resin acid value represents the number of mg of potassium hydroxide required to neutralize the acid containing in 1 g of sample obtained by dissolving the resin in a mixed solution of alcohol and toluene, using phenolphthalein as the indicator.

The resin comprising the compound fine particles (A) and resin (B) according to the invention may also be used in combination with other resins, examples of which include acrylic resins, epoxy resins, silicone resins, styrene resins and alkyd resins, as well as acrylic resins with low average molecular weights (e.g. $10^3$–$3\times10^4$) and resins with high acid values (e.g. 10–100).

However, when the resin used in combination has a resin acid value, the intended effect of the invention is impaired if the total resin acid value exceeds 15, or if the resin is in excess of 30 wt % of the total binding resin weight of the resin of the invention.

The silica particle diameter in the compound fine particles (A) is preferably not greater than 200 nm, because this will cause diffusion of light irradiated on the electrophotographic photosensitive body, thus notably impairing the electrophotographic characteristics, such as the imaging properties and electrical characteristics.

If the acid value of the resin (B) is less than 2.0, the dispersability of the photoconductive paint will be lower, thus impairing the coating strength of the electrophotographic photosensitive body surface and the adhesion and imaging property (for example, the image density) of the conductive substrate. If it is greater than 12, the light response sensitivity will be slower, resulting in a poorer desensitizing property.

The weight ratio of the compound fine particles (A) and resin (B) used according to the invention will differ depending on the type, particle diameter and surface condition of the inorganic photoconductive body used, but generally the proportion of the compound fine particles (A)/resin (B) in terms of weight ratio is in the range of 0.5/9.5–4.0/6.0, and preferably in the range of 1.0/9.0–3.5/6.5.

The inorganic photoconductive body used for the invention may be zinc oxide, titanium oxide, zinc sulfide, cadmium sulfide, zinc selenide, cadmium selenide, tellurium selenide, lead sulfide, etc., among which are preferred zinc oxide and titanium oxide. The total amount of the binding resin used for the inorganic photoconductive body is a proportion of 10–35 parts by weight, and preferably 15–30 parts by weight of the binding resin to 100 parts by weight of the inorganic photoconductive body.

According to the invention, a dye may be also be used as a spectral sensitizer if necessary. As examples there may be mentioned carbonium-based pigments, diphenylmethane pigments, triphenylmethane pigments, xanthene pigments, phthalein pigments, polymethine pigments and phthalocyanine pigments (which may also contain metals).

Any of various additives may also be used as chemical sensitizers in the photoconductive layer of the invention. As examples there may be mentioned electron acceptor compounds (halogens, benzoquinones, chloranil, acid anhydrides, organic carboxylic acids, etc.), polyarylalkane compounds, hindered phenol compounds and p-phenylenediamine compounds.

These dyes and additives may be added in an amount of 0.001–2.0 parts by weight to 100 parts by weight of the photoconductive body.

The photoconductive layer is applied in an amount of 10–40 g/m$^2$, and preferably 15–35 g/m$^2$.

The photoconductive layer of the invention may be provided on a conventional publicly known conductive substrate. This may be, for example, a base of aluminum or other metal, paper or plastic film, or a double layer or composite thereof, impregnated with a low resistance substance and subjected to conductive treatment; a base surface rendered conductive (on the side opposite the photoconductive layer) and further coated with at least one layer intended to impart humidity resistance or prevent curling; a substrate surface provided with a water-resistant coating layer; a substrate surface precoated with at least one layer; or plastic deposited with aluminum vapor and laminated with paper.

DESCRIPTION OF THE PREFERRED EMBODIMENTS

Examples of the invention will now be provided.

EXAMPLE 1

(Solid Weight Ratio A/B=2.0/8.0)

Compound Fine Particle Dispersion (A-1)

| | |
|---|---|
| average particle diameter: 27 nm | 16 parts by weight |
| Resin (B-1) (acryl/styrene copolymer) resin acid value: 6.0 (acid value adjusted with copolymerizable unsaturated acid) | 40 parts by weight |

-continued

| | |
|---|---|
| Photoconductive zinc oxide | 100 parts by weight |
| Rose bengal (2% methanol solution) | 5 parts by weight |
| Toluene | 80 parts by weight |

The above mixture was dispersed to prepare a photoconductive paint. The paint was coated onto a conductively treated electrophotographic base sheet (water resistant base sheet for lithographic printing plates) in an amount of 25 g/m$^2$ using a wire bar, and the coating was dried at 100° C. for one minute. It was then allowed to stand for 24 hours in a dark place at 20° C., 60% RH to manufacture an electrophotographic photosensitive sheet.

EXAMPLE 2

(Solid Weight Ratio A/B=0.5/9.5)

An electrophotographic photosensitive sheet was manufactured in the same manner as Example 1, except that the content of the compound fine particle dispersion (A-1) in Example 1 was changed to 4 parts by weight and the content of the resin (B-1) to 47.5 parts by weight.

EXAMPLE 3

(Solid Weight Ratio A/B=1.0/9.0)

An electrophotographic photosensitive sheet was manufactured in the same manner as Example 1, except that the content of the compound fine particle dispersion (A-1) in Example 1 was changed to 8 parts by weight and the content of the resin (B-1) to 45 parts by weight.

EXAMPLE 4

(Solid Weight Ratio A/B=3.5/6.5)

An electrophotographic photosensitive sheet was manufactured in the same manner as Example 1, except that the content of the compound fine particle dispersion (A-1) in Example 1 was changed to 28 parts by weight and the content of the resin (B-1) to 32.5 parts by weight.

EXAMPLE 5

(Solid Weight Ratio A/B=4.0/6.0)

An electrophotographic photosensitive sheet was manufactured in the same manner as Example 1, except that the content of the compound fine particle dispersion (A-1) in Example 1 was changed to 32 parts by weight and the content of the resin (B-1) to 30 parts by weight.

Comparative Example a (Solid Weight Ratio A/B=0.25/9.75)

An electrophotographic photosensitive sheet was manufactured in the same manner as Example 1, except that the content of the compound fine particle dispersion (A-1) in Example 1 was changed to 2 parts by weight and the content of the resin (B-1) to 48.75 parts by weight.

Comparative Example b (Solid Weight Ratio A/B=4.5/5.5)

An electrophotographic photosensitive sheet was manufactured in the same manner as Example 1, except that the content of the compound fine particle dispersion (A-1) in Example 1 was changed to 36 parts by weight and the content of the resin (B-1) to 27.5 parts by weight.

EXAMPLE 6

(Resin Acid Value: 2.0)

An electrophotographic photosensitive sheet was manufactured in the same manner as Example 1, except that resin (B-1) in Example 1 was replaced with resin (B-2) having a resin acid value of 2.0.

EXAMPLE 7

(Resin Acid Value: 12.0)

An electrophotographic photosensitive sheet was manufactured in the same manner as Example 1, except that resin (B-1) in Example 1 was replaced with resin (B-3) having a resin acid value of 12.0.

Comparative Example c (Resin Acid Value: 1.5)

An electrophotographic photosensitive sheet was manufactured in the same manner as Example 1, except that resin (B-1) in Example 1 was replaced with resin (B-4) having a resin acid value of 1.5.

Comparative Example d (Resin Acid Value: 13.0)

An electrophotographic photosensitive sheet was manufactured in the same manner as Example 1, except that resin (B-1) in Example 1 was replaced with resin (B-5) having a resin acid value of 13.0.

EXAMPLE 8

(Compound Fine Particle Average Particle Diameter: 5 nm)

An electrophotographic photosensitive sheet was manufactured in the same manner as Example 1, except that the compound fine particle dispersion (A-1) in Example 1 was replaced with compound fine particle dispersion (A-2) having an average particle diameter of 5 nm.

EXAMPLE 9

(Compound Fine Particle Average Particle Diameter: 200 nm)

An electrophotographic photosensitive sheet was manufactured in the same manner as Example 1, except that the compound fine particle dispersion (A-1) in Example 1 was replaced with compound fine particle dispersion (A-3) having an average particle diameter of 200 nm.

Comparative Example e (Compound Fine Particle Average Particle Diameter: 220 nm)

An electrophotographic photosensitive sheet was manufactured in the same manner as Example 1, except that the compound fine particle dispersion (A-1) in Example 1 was replaced with compound fine particle dispersion (A-4) having an average particle diameter of 220 nm.

EXAMPLE 10

(10 Parts by Weight of Binding Resin to 100 Parts by Weight of Inorganic Photoconductive Body)

An electrophotographic photosensitive sheet was manufactured in the same manner as Example 1, except that the content of the compound fine particle dispersion (A-1) in Example 1 was changed to 8 parts by weight and the content of the resin (B-1) to 20 parts by weight.

EXAMPLE 11

(15 Parts by Weight of Binding Resin to 100 Parts by Weight of Inorganic Photoconductive Body)

An electrophotographic photosensitive sheet was manufactured in the same manner as Example 1, except that the content of the compound fine particle dispersion (A-1) in Example 1 was changed to 12 parts by weight and the content of the resin (B-1) to 30 parts by weight.

EXAMPLE 12

(30 Parts by Weight of Binding Resin to 100 Parts by Weight of Inorganic Photoconductive Body)

An electrophotographic photosensitive sheet was manufactured in the same manner as Example 1, except that the content of the compound fine particle dispersion (A-1) in Example 1 was changed to 24 parts by weight and the content of the resin (B-1) to 60 parts by weight.

EXAMPLE 13

(35 Parts by Weight of Binding Resin to 100 Parts by Weight of Inorganic Photoconductive Body)

An electrophotographic photosensitive sheet was manufactured in the same manner as Example 1, except that the content of the compound fine particle dispersion (A-1) in Example 1 was changed to 28 parts by weight and the content of the resin (B-1) to 70 parts by weight.

Comparative Example f (5 Parts by Weight of Binding Resin to 100 Parts by Weight of Inorganic Photoconductive Body)

An electrophotographic photosensitive sheet was manufactured in the same manner as Example 11 except that the content of the compound fine particle dispersion (A-1) in Example 1 was changed to 4 parts by weight and the content of the resin (B-1) to 10 parts by weight.

Comparative Example g (40 Parts by Weight of Binding Resin to 100 Parts by Weight of Inorganic Photoconductive Body)

An electrophotographic photosensitive sheet was manufactured in the same manner as Example 1, except that the content of the compound fine particle dispersion (A-1) in Example 1 was changed to 32 parts by weight and the content of the resin (B-1) to 80 parts by weight.

EXAMPLE 14

(Coating Amount: 10 g/m$^2$)

An electrophotographic photosensitive sheet was manufactured in the same manner as Example 1, except that the wire bar alignment in Example 1 was altered to adjust the coating amount to 10 g/m$^2$.

EXAMPLE 15

(Coating Amount: 15 g/m$^2$)

An electrophotographic photosensitive sheet was manufactured in the same manner as Example 1, except that the wire bar alignment in Example 1 was altered to adjust the coating amount to 15 g/m$^2$.

EXAMPLE 16

(Coating Amount: 35 g/m$^2$)

An electrophotographic photosensitive sheet was manufactured in the same manner as Example 1, except that the wire bar alignment in Example 1 was altered to adjust the coating amount to 35 g/m$^2$.

EXAMPLE 17

(Coating Amount: 40 g/m$^2$)

An electrophotographic photosensitive sheet was manufactured in the same manner as Example 1, except that the wire bar alignment in Example 1 was altered to adjust the coating amount to 40 g/m$^2$.

Comparative Example h (Coating Amount: 5 g/m$^2$)

An electrophotographic photosensitive sheet was manufactured in the same manner as Example 1, except that the wire bar alignment in Example 1 was altered to adjust the coating amount to 5 g/m$^2$.

Comparative Example i (Coating Amount: 45 g/m$^2$)

An electrophotographic photosensitive sheet was manufactured in the same manner as Example 1, except that the wire bar alignment in Example 1 was altered to adjust the coating amount to 45 g/m$^2$.

The imaging properties of these manufactured electrophotographic photosensitive bodies and their printing properties when used as lithographic printing plates were examined, and the results are shown in the following tables.

TABLE 1

| | Electrophotographic photosensitive sheet | | | | | | | | | Lithographic printing plate | | | |
|---|---|---|---|---|---|---|---|---|---|---|---|---|---|
| | Exposure | Image density *2 | | | Scum on non-image sections *3 | | | Electrical | | Peeling at image | Indentation | Scum on printed | No. of sheets |
| Example | setting *1 | 20° C. 60% | 30° C. 80% | 10° C. 30% | 20° C. 60% | 30° C. 80% | 10° C. 30% | characteristics *4 Charge | D.D. | sections *5 | smudge *6 | product *7 | printed *8 |
| Ex. 1 | 30 | 1.55 | 1.50 | 1.47 | ○ | ○ | ○ | 590 | 87 | ○ | ○ | ○ | 7000 |
| Ex. 2 | 25 | 1.61 | 1.57 | 1.55 | ○ | ○ | ○ | 620 | 88 | ○ | ○ | ○ | 7000 |
| Ex. 3 | 28 | 1.58 | 1.55 | 1.53 | ○ | ○ | ○ | 610 | 88 | ○ | ○ | ○ | 7000 |
| Ex. 4 | 32 | 1.52 | 1.50 | 1.47 | ○ | ○ | ○ | 560 | 85 | ○ | ○ | ○ | 7000 |
| Ex. 5 | 35 | 1.50 | 1.49 | 1.46 | ○ | ○ | ○ | 540 | 83 | ○ | ○ | ○ | 7000 |
| Ex. 6 | 25 | 1.50 | 1.47 | 1.45 | ○ | ○ | ○ | 520 | 82 | ○ | ○ | ○ | 7000 |
| Ex. 7 | 35 | 1.62 | 1.59 | 1.55 | ○ | ○ | ○ | 630 | 88 | ○ | ○ | ○ | 7000 |
| Ex. 8 | 27 | 1.56 | 1.53 | 1.51 | ○ | ○ | ○ | 580 | 87 | ○ | ○ | ○ | 7000 |
| Ex. 9 | 35 | 1.52 | 1.49 | 1.46 | ○ | ○ | ○ | 580 | 86 | ○ | ○ | ○ | 7000 |
| Ex. 10 | 26 | 1.50 | 1.48 | 1.45 | ○ | ○ | ○ | 520 | 81 | ○ | ○ | ○ | 7000 |
| Ex. 11 | 28 | 1.54 | 1.51 | 1.47 | ○ | ○ | ○ | 550 | 83 | ○ | ○ | ○ | 7000 |
| Ex. 12 | 33 | 1.57 | 1.50 | 1.52 | ○ | ○ | ○ | 590 | 87 | ○ | ○ | ○ | 7000 |
| Ex. 13 | 35 | 1.61 | 1.57 | 1.53 | ○ | ○ | ○ | 620 | 88 | ○ | ○ | ○ | 7000 |
| Ex. 14 | 26 | 1.50 | 1.48 | 1.45 | ○ | ○ | ○ | 5i0 | 83 | ○ | ○ | ○ | 7000 |
| Ex. 15 | 28 | 1.54 | 1.50 | 1.48 | ○ | ○ | ○ | 570 | 86 | ○ | ○ | ○ | 7000 |
| Ex. 16 | 33 | 1.59 | 1.56 | 1.52 | ○ | ○ | ○ | 600 | 87 | ○ | ○ | ○ | 7000 |
| Ex. 17 | 35 | 1.63 | 1.60 | 1.57 | ○ | ○ | ○ | 640 | 88 | ○ | ○ | ○ | 7000 |

TABLE 2

| | Electrophotographic photosensitive sheet | | | | | | | | | Lithographic printing plate | | | |
|---|---|---|---|---|---|---|---|---|---|---|---|---|---|
| Comparative | Exposure | Image density *2 | | | Scum on non-image sections *3 | | | Electrical | | Peeling at image | Indentation | Scum on printed | No. of sheets |
| Example | setting *1 | 20° C. 60% | 30° C. 80% | 10° C. 30% | 20° C. 60% | 30° C. 80% | 10° C. 30% | characteristics *4 Charge | D.D. | sections *5 | smudge *6 | product *7 | printed *8 |
| Comp. Ex. a | 22 | 1.65 | 1.61 | 1.57 | ○ | ○ | ○ | 630 | 89 | Δ | ○ | X | 3000 |
| Comp. Ex. b | 38 | 1.45 | 1.42 | 1.39 | Δ | X | Δ | 500 | 79 | ○ | Δ | ○ | 5000 |
| Comp. Ex. c | 21 | 1.42 | 1.39 | 1.36 | Δ | Δ | X | 470 | 78 | Δ | Δ | ○ | 5000 |
| Comp. Ex. d | 39 | 1.67 | 1.65 | 1.62 | ○ | ○ | ○ | 660 | 89 | ○ | ○ | X | 3000 |
| Comp. Ex. e | 46 | 1.42 | 1.40 | 1.36 | Δ | X | Δ | 470 | 76 | Δ | Δ | ○ | 5000 |
| Comp. Ex. f | 20 | 1.44 | 1.40 | 1.37 | ○ | Δ | Δ | 470 | 74 | X | Δ | ○ | 2000 |
| Comp. Ex. g | 38 | 1.65 | 1.61 | 1.58 | Δ | Δ | ○ | 660 | 88 | ○ | ○ | Δ | 7000 |
| Comp. Ex. h | 18 | 1.40 | 1.35 | 1.33 | ○ | ○ | Δ | 420 | 70 | X | X | ○ | 2000 |
| Comp. Ex. i | 37 | 1.67 | 1.64 | 1.60 | Δ | ○ | Δ | 680 | 88 | ○ | ○ | Δ | 7000 |

Notes

*1 Exposure setting

The exposure setting at which the best image was obtained when photographing on the electrophotographic photosensitive sheet using an AP-10EX photoengraver and AP-10 developing solution set (both products of IWATSU ELECTRIC Co., Ltd.), where smaller values indicate higher sensitivity.

*2 Image density

The value measured with a Macbeth reflection densitometer (Model RD-514 by Macbeth, Co. U.S.) at a solid section of a photographed image, where higher values indicate higher image density.

Also, the temperature and humidity environments represent the reflection density values for photographs taken after leaving the electrophotographic photosensitive sheet, photoengraver and developing solution under various environmental conditions for a day and a night.

*3 Scum on non-imaged sections

Visual examination was made of the scum on non-image sections of the samples subjected to image density measurement.

The evaluation scale was: o=no scum, Δ=slight scum, x=presence of scum rendered electrophotographic photosensitive sheet unsuitable for use.

*4 Electrical characteristics

The charge was the surface potential after 5 seconds (V5) under −6 KV corona discharge using an electrostatic charge tester (model EPA-8100 by IWATSU ELECTRIC Co., Ltd.) at 20° C., 60% RH.

The surface potential V60 was then measured after 60 seconds under this condition, and the potential retention upon darkness damping, i.e. the darkness damping retention (D.D.) was calculated as (V60/V5)×100 (%).

*5 Peeling at image sections

In order to apply the photographed electrophotographic photosensitive sheet as a lithographic printing plate, a desensitizing V-etching solution (product of IWATSU ELECTRIC Co., Ltd.) was used for a single desensitizing treatment with an etching processor (model HP-320, product of IWATSU ELECTRIC Co., Ltd.), which was followed by printing (mode Besty-4700CD by Tokyo Aerial Instruments, KK. and mode 3200PFA by Ryobi Co.) and visual examination of the peeling from the lithographic printing plate at image sections during printing of 5000 sheets.

The evaluation scale was: o=no peeling, Δ=imminent peeling, x=peeling.

*6 Indentation smudge

An abrasive nick (indentation with a load of 100 g) was made in the electrophotographic photosensitive sheet, and its appearance as a smudge in printed products was determined by visual examination of 100 printed sheets printed under the same conditions as for the peeling evaluation of the image sections. The coating strength can be judged by this evaluation.

The evaluation scale was: o=no indentation smudge, Δ=slight smudge, x=smudge.

*7 Scum on printed product

The scum on 5000 printed sheets was visually examined with printing under the same conditions as for evaluation of peeling of the image sections. The reactivity with the desensitizing solution can be judged by this evaluation.

The evaluation scale was: o=no scum, Δ: slight scum, x=scum.

*8 Number of sheets printed

The number of sheets which were printed without image problems (peeling at image sections, reproducibility of fine lines and blind spots, smudges, etc.) upon printing 7000 sheets under the same conditions as for the evaluation of peeling at image sections, where a larger number of printed sheets represents better printing resistance.

As shown in the preceding tables, the electrophotographic photosensitive bodies consisting of conductive substrates coated with photoconductive paints according to the invention obtained by mixing and dispersing compound fine particles (A) at a proportion of 0.5–4.0 by weight to the total binding resin, when used as electrophotographic photosensitive sheets, provide excellent image density and low scum on non-imaged sections, and also exhibit superior performance against environmental changes.

They were also demonstrated to have satisfactory electrical characteristics, and when used as lithographic printing plates they exhibited excellence in terms of coating strength, reasolutions, scum and pizing solutions, scum and printing resistance.

Furthermore, as shown in the tables, since all of the comparative examples failed to be satisfactory in all electrophotographic photosensitive properties and lithographic printing plate properties, excellent photoconductive paints were obtained only within the ranges of the examples of the invention, and electrophotographic photosensitive sheets prepared with them were demonstrated to exhibit superior performance.

Effect of the Invention

According to the invention, photoconductive paints obtained by dispersing compound fine particles (A) in a proportion of 0.5–4.0 by weight to total binding resins are photoconductive paints which exhibit excellent performance as electrophotographic photosensitive sheets of electrophotographic photosensitive bodies formed on conductive substrates, and electrophotographic photosensitive bodies manufactured by forming such paints on conductive substrates give excellent imaging properties, electrical characteristics and environmental stability. They can also be used for lithographic printing plates with excellent coating strength, reactivity with desensitizing solutions, and printing resistance.

What is claimed is:

1. A photoconductive paint composed primarily of an inorganic photoconductive material and a binding resin, which photoconductive paint is characterized in that said binding resin comprises compound fine particles (A) and a resin (B), in a solid weight ratio of compound fine particles (A)/resin (B) in the range of 0.5/9-5–4.0/6.0;

wherein the compound fine particles (A) are compound fine particles wherein an organic polymer is bound to surfaces of inorganic fine particles, the average particle diameter is 5–200 nm, and the coefficient of particle diameter variation is not greater than 50%;

resin (B) is a resin which is a resin composition obtained by polymerizing an acrylic monomer mixture comprising a plurality of acrylic monomers, and which has an acid value of 2.0–12.0.

2. An electrophotographic photosensitive body characterized by forming a photoconductive paint according to claim 1 on a conductive substrate.

* * * * *

UNITED STATES PATENT AND TRADEMARK OFFICE

CERTIFICATE OF CORRECTION

PATENT NO. : 5,968,694
DATED : October 19, 1999
INVENTOR(S) : Sakai et al.

It is certified that error appears in the above-identified patent and that said Letters Patent is hereby corrected as shown below:

Title page,
Item [73], should read -- Iwatsu Electric Co., Ltd., Tokyo; Nippon Shokubai, Osaka, both Japan --

Signed and Sealed this

Nineteenth Day of February, 2002

*Attest:*

*Attesting Officer*

JAMES E. ROGAN
*Director of the United States Patent and Trademark Office*